US009968978B2

(12) United States Patent
Villain-Chastre et al.

(10) Patent No.: US 9,968,978 B2
(45) Date of Patent: May 15, 2018

(54) DEFORMATION APPARATUS

(71) Applicant: Safran Landing Systems UK Ltd, Gloucester, Gloucestershire (GB)

(72) Inventors: Jean-Philippe Villain-Chastre, Cheltenham (GB); Germain Forgeoux, Cheltenham (GB); Przemyslaw Grochola, Chelm (PL)

(73) Assignee: Safran Landing Systems UK Ltd. (GB)

( * ) Notice: Subject to any disclaimer, the term of this patent is extended or adjusted under 35 U.S.C. 154(b) by 270 days.

(21) Appl. No.: 14/780,847

(22) PCT Filed: Mar. 10, 2014

(86) PCT No.: PCT/GB2014/050702
§ 371 (c)(1),
(2) Date: Sep. 28, 2015

(87) PCT Pub. No.: WO2014/155053
PCT Pub. Date: Oct. 2, 2014

(65) Prior Publication Data

US 2016/0052038 A1 Feb. 25, 2016

(30) Foreign Application Priority Data

Mar. 28, 2013 (GB) ..... 1305754.2

(51) Int. Cl.
*B21D 26/033* (2011.01)
*B21D 22/16* (2006.01)
*B21D 31/06* (2006.01)

(52) U.S. Cl.
CPC ..... *B21D 26/033* (2013.01); *B21D 22/16* (2013.01); *B21D 31/06* (2013.01); *Y10T 29/49805* (2015.01)

(58) Field of Classification Search
CPC ..... B21D 15/03; B21D 15/10; B21D 22/14; B21D 22/16; B21D 26/02; B21D 26/033;
(Continued)

(56) References Cited

U.S. PATENT DOCUMENTS 5,332,643 A * 7/1994 Harada ..... G03G 5/102 430/127
5,344,508 A 9/1994 Gilman
(Continued)

FOREIGN PATENT DOCUMENTS

CN 102527809 7/2012
DE 120133 6/1976
(Continued)

OTHER PUBLICATIONS

International Search Report for International Application No. PCT/GB2014/050702 dated Jul. 23, 2014.
(Continued)

*Primary Examiner* — Peter DungBa Vo
*Assistant Examiner* — Joshua D Anderson
(74) *Attorney, Agent, or Firm* — RatnerPrestia

(57) ABSTRACT

Apparatus configured to deform a tubular work piece having a longitudinal axis, the apparatus comprising a support for supporting a tubular work piece to be deformed; rotation means for rotating the tubular work piece about its longitudinal axis; a nozzle for directing a stream of pressurized fluid at the tubular work piece in a direction transverse to the longitudinal axis of the tubular work piece; and means for moving one or both of the tubular work piece and the nozzle relative to one another such that the stream of pressurized fluid can be aimed at a plurality of locations along the tubular work piece; wherein the pressure of the fluid directed at the tubular work piece is great enough to cause deforma-
(Continued)

tion of the tubular work piece, but not so great that cutting of the tubular work piece can occur.

20 Claims, 6 Drawing Sheets

(58) Field of Classification Search
CPC ..... B21D 31/005; B21D 31/06; B24C 1/02; B24C 1/08; B24C 1/10; Y10T 29/497; Y10T 29/49805; B21J 5/04; B23B 1/00
USPC ..... 72/53, 54, 56, 60, 68, 80, 82, 84, 367.1, 72/368, 370.01, 370.14, 370.22
See application file for complete search history.

(56) References Cited

U.S. PATENT DOCUMENTS

| | | | | |
|---|---|---|---|---|
| 5,762,538 | A * | 6/1998 | Shaffer | B24B 1/00 408/144 |
| 6,305,204 | B1 | 10/2001 | Tauzer | |
| 6,615,695 | B1 | 9/2003 | Hjelle | |
| 2005/0279630 | A1 | 12/2005 | Fonte | |
| 2010/0083783 | A1 | 4/2010 | Szuba | |
| 2010/0236122 | A1 | 9/2010 | Fonte | |
| 2011/0011253 | A1 | 1/2011 | Fonte | |
| 2011/0088803 | A1 | 4/2011 | Geskin | |
| 2012/0031516 | A1 | 2/2012 | Yori | |
| 2015/0111473 | A1* | 4/2015 | Geyer | B24C 1/10 451/40 |

FOREIGN PATENT DOCUMENTS

| | | |
|---|---|---|
| DE | 4230143 | 3/1994 |
| EP | 1195206 | 4/2002 |
| EP | 1870196 | 12/2007 |
| GB | 1325759 | 8/1973 |
| JP | 2000061570 | 2/2000 |
| WO | 9829206 | 7/1998 |

OTHER PUBLICATIONS

Written Opinion of the International Searching Authority for International Application No. PCT/GB2014/050702 dated Jul. 23, 2014.

* cited by examiner

DEFORMATION APPARATUS

This application is a U.S. National Phase application of PCT International Application No. PCT/GB2014/050702 filed Mar. 10, 2014, which claims the benefit of GB 1305754.2, filed Mar. 28, 2013, both of which are incorporated by reference herein.

BACKGROUND TO THE INVENTION

Flow-forming is a known metal-forming technique in which a piece of material to be worked is secured to a mandrel and rotated while one or more rollers are used to apply pressure to an external surface of the work piece in order to deform the work piece as it is rotated. The roller compresses the work piece against the mandrel causing the work piece to become deformed both by lengthening it axially and thinning it radially. Owing to the large amount of pressure applied by the roller or rollers to the work piece, and owing to the rotation of the work piece relative to the roller or rollers, the work piece is subjected to a large amount of friction during the flow forming process. Consequently, the temperature of the work piece can increase to several hundred degrees Celsius during the process. Such a high temperature can have an undesired effect on the work piece, such as changing the properties of the material from which the work piece is formed. Furthermore, the rollers can become worn, and regularly need replacing. Regular replacement of rollers can lead to high running costs.

SUMMARY OF INVENTION

According to a first aspect, the present invention provides apparatus configured to deform a tubular work piece having a longitudinal axis, the apparatus comprising: a support for supporting a tubular work piece to be deformed; rotation means for rotating the tubular work piece about its longitudinal axis; a nozzle for directing a stream of pressurised fluid at the tubular work piece in a direction transverse to the longitudinal axis of the tubular work piece; and means for moving one or both of the tubular work piece and the nozzle relative to one another such that the stream of pressurised fluid can be aimed at a plurality of locations along the tubular work piece; wherein the pressure of the fluid directed at the tubular work piece is great enough to cause deformation of the tubular work piece, but not so great that cutting of the tubular work piece can occur.

The use of a fluid to deform a tubular work piece has many advantages. Firstly, using a fluid avoids the need to use a cooling system as is needed in a system which uses solid rollers to deform a work piece. A fluid can act as a coolant while it deforms the work piece. Secondly, rollers used in existing deformation systems can become worn and damaged. Using a fluid instead of rollers avoids the need to replace or repair rollers. Thirdly, the compressive effect of the fluid on the tubular work piece can alter properties of the tubular work piece, for example increasing the strength of the work piece.

The support may comprise a mandrel and/or the rotation means may comprise a lathe. Alternatively, the support and rotation means comprise a mandrel.

The nozzle may be mounted on a rail to enable it to be moved relative to the tubular work piece and/or may be pivotable relative to the tubular work piece.

The nozzle may be configured to move in at least one of: (i) a direction parallel with the longitudinal axis of the tubular work piece; and (ii) a direction transverse to the longitudinal axis of the tubular work piece.

The pressurised fluid may comprise water and may further comprise an abrasive.

The nozzle may comprise one of a plurality of nozzles arranged circumferentially around the tubular work piece and/or substantially linearly along the length of the support.

The nozzle may comprise one of a plurality of sets of nozzles, each set of nozzles being positioned at a different radial distance from the tubular member. The nozzles of each individual set of nozzles may be arranged circumferentially around the tubular work piece.

According to a second aspect, the present invention provides a method for deforming a tubular work piece, the method comprising: providing a tubular work piece to be deformed, the tubular work piece having a longitudinal axis; directing a stream of pressurised fluid at the tubular work piece in a direction transverse to the longitudinal axis; rotating the tubular work piece about the longitudinal axis; and moving one or both of the tubular work piece and the nozzle relative to one another such that the stream of pressurised fluid can be aimed at a plurality of locations along the tubular work piece; wherein the pressure of the pressurised fluid directed at the tubular work piece is great enough to cause deformation of the tubular work piece, but not so great that cutting of the tubular work piece can occur.

The pressurised fluid may be directed at the tubular work piece by a nozzle mounted on a rail. The method may further include the step of moving the nozzle along the rail relative to the tubular work piece.

The pressurised fluid may be directed at the tubular work piece by a nozzle, and the nozzle may be moved in at least one of: (i) a direction parallel with the longitudinal axis of the tubular work piece; and (ii) a direction transverse to the longitudinal axis of the tubular work piece, as the tubular work piece is rotated.

The nozzle may comprise one of a plurality of nozzles, each of the nozzles being movable independently relative to the tubular work piece.

The nozzle may comprise one of a plurality of sets of nozzles, each set of nozzles being positioned at a different radial distance from the tubular member, and movable relative to the tubular work piece and to the other of the plurality of sets of nozzles.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
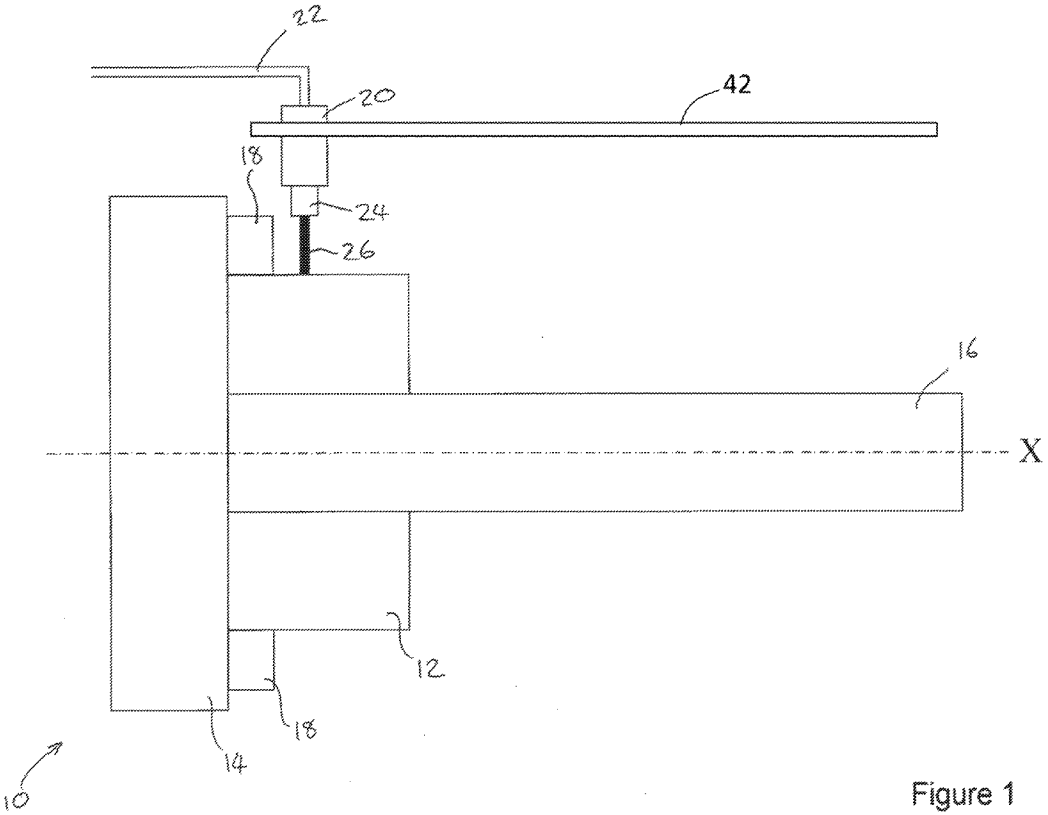
FIG. 1 is a schematic cross section through an apparatus constructed in accordance with a first embodiment of the invention at a first stage during use.

Referring to the drawings, FIG. 1 shows a sectional view of an apparatus 10 for deforming, or manipulating the shape of, a tubular work piece 12. The apparatus 10 includes a device 14 for rotating the work piece 12 about a longitudinal axis X of the work piece. In this embodiment, the device 14 is a lathe. However, it will be appreciated by those skilled in the art that the device could be any similar tool or device suitable for rotating the work piece 12 about its longitudinal axis X.

A support 16 for the work piece 12 is connected to, or formed integrally with, the lathe 14, and forms a surface against which the work piece is held and deformed during use. The support 16 is, in this embodiment, a mandrel. The support 16 may be a shaft having a cylindrical cross section. However, the support 16 may take an alternative form, such as a shaft with a square or rectangular cross section. The form of the support 16 can be chosen based on the shape of the work piece 12 to be worked. In this embodiment, the work piece 12 is a hollow tubular work piece with a generally circular cross section. The diameter of the support 16 is chosen or configured to be substantially the same as the diameter of the opening through the tubular work piece 12, so that the work piece is able to fit tightly onto the support, ideally with a frictional fit.

A clamp 18 is connected to, or formed integrally with, the lathe 14, and serves to secure the work piece 12 against the lathe and against the support 16. It will be apparent to those skilled in the art that the clamp 18 may take various known forms, and may include means to enable a user to manually tighten the clamp against the work piece 12, for example by using one or more screws or bolts (not shown), or means for automatically tightening the clamp against the work piece, for example electronically. The clamp 18 may surround a portion or all of the work piece 12. In alternative embodiments, the work piece 12 may be secured to the lathe 14 and to the support 16 using alternative means, for example by attaching the work piece through an opening in the lathe. In such embodiments, a clamp 18 is not necessary. In embodiments where a clamp 18 is used, it may not be possible for the portion of the work piece 12 that is clamped to the support 16 to be deformed. Therefore, the clamped portion of the work piece 12 may be removed after deformation of the work piece.

The apparatus 10 further includes means 20 for directing and supplying a fluid towards the work piece 12. In this embodiment, a nozzle 20 is connected by a fluid delivery pipe 22 to a fluid source (not shown) for directing and supplying fluid to the work piece 12. The nozzle 20 is configured to supply a fluid under very high pressure via the fluid supply pipe 22 to the work piece 12. The fluid may be stored in the fluid source under high pressure. Alternatively, the fluid may be stored in the fluid source at an ambient pressure, and pressurised by some other means, such as by passing the fluid through a pressurising pump before being fed out of the nozzle 20. The pressurised fluid is ejected from the nozzle 20 via an opening 24 in the nozzle. The nozzle 20 is aimed towards the work piece 12 such that, in use, fluid from the nozzle is directed towards the work piece in a direction transverse to the longitudinal axis X of the work piece.

It should be noted that the expression "transverse to" is intended to encompass any direction which results in fluid from the nozzle 20 being directed at the work piece 12. For example, the nozzle 20 may be oriented in a direction perpendicular to the longitudinal axis X of the work piece 12, or oriented such that fluid is ejected from the opening 24 in the nozzle 20 at an angle of between 0 and 90 degrees with respect to the longitudinal axis X of the work piece.

In use, the work piece 12 is mounted onto the support 16 and clamped against the support and against the lathe 14 using the clamp 18. The lathe 14 then rotates about the longitudinal axis X of the work piece, thereby rotating the support 16 and the work piece 12. As the work piece 12 is rotated pressurised fluid 26 is expelled at high speed from the nozzle 20 onto an exterior surface of the work piece 12. The force of the fluid 26 acting on the work piece 12 causes localised compression of the work piece against the support 16. That is to say, the portion of the surface of the work piece that is hit by the fluid will be compressed as a result of the impact. If the force of the fluid 26 upon the work piece 12 is sufficient, then localised deformation of the work piece will occur.

It will be clear that, since the lathe 14 rotates the work piece 12 while the fluid 26 is propelled onto the work piece, a channel will form around a circumference of the work piece. Typically, it is desirable to thin the work piece 12 evenly and without channels, such that the resulting work piece has a wall of substantially uniform thickness along its length. To achieve such a result, it is necessary for the exterior surface of the work piece 12 to be worked equally around its circumference and along its length. An effect of the compression caused by the pressurised fluid 26 is that the thickness of the wall of the work piece 12 is decreased as it is forced against the support 16. Additionally, the work piece is forced along the support 16 in a direction parallel with the longitudinal axis X of the support. In other words, as the wall of the work piece 12 is thinned, the length of the work piece is increased. Accordingly, the present invention can be used to thin the walls of a tubular work piece 12, and increase the length of the tubular work piece. It will be apparent to those skilled in the art that the desired length of the resulting work piece 12 and the desired thickness of the walls of the resulting work piece can be achieved by applying the pressurised fluid 26 to a work piece for a particular duration.

Figure 2:
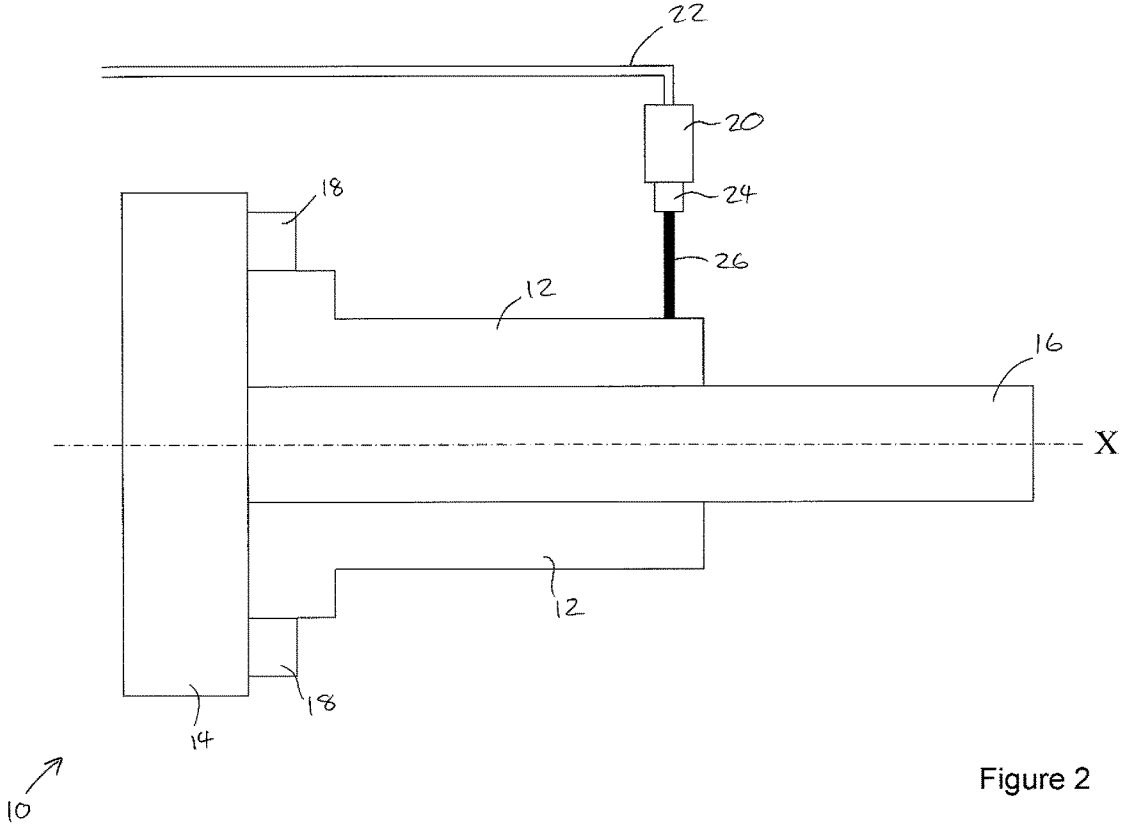
FIG. 2 is a schematic cross section through the apparatus shown in FIG. 1 at a second stage during use.

To achieve even deformation of the work piece 12 and to cause the length of the work piece to increase as a result of being worked, the apparatus 10 includes means for introducing relative movement between the work piece and the nozzle. In this embodiment as the lathe 14 rotates the support 16 and work piece 12 the nozzle 20 is moved along the length of the work piece in a direction parallel to its longitudinal axis X while the nozzle expels the pressurised fluid 26. The lathe 14, support 16 and work piece 12 do not move in a direction parallel to its longitudinal axis X. In this way, the nozzle 20 moves relative to the work piece 12. In another embodiment (not shown) it can be envisaged that the nozzle 20 could remain stationary and the work piece 12 could move relative to the nozzle 20. FIG. 2 shows the apparatus 10 with the nozzle 20 in a position further away from the lathe 14 than the position shown in FIG. 1. FIG. 2 also shows a change in the shape of the work piece 12 as a result of the application of the fluid 26 on the work piece and of the movement of the nozzle 20 along at least a portion of the length of the support 16.

The movement of the nozzle 20 along the work piece 12 can be achieved by any known and suitable means. For example, in one embodiment, the nozzle 20 is mounted on a rail 42 (which is shown schematically in FIG. 1) which extends parallel to the longitudinal axis X of the support 16. The nozzle 20 is slidably mounted on the rail and, using suitable electronics and/or mechanics, the nozzle can be moved along the rail in either direction as required. It will be appreciated that in some cases it will be desirable to move the nozzle 20 backwards and forwards along the length of the work piece 12 a number of times during application of the fluid 26 to reduce the thickness of the wall of the work piece to a desired thickness. The amount of compression of the work piece 12 caused by the impact of the fluid 26 will vary as the function of the pressure at which the fluid is ejected from the nozzle 20. A fluid 26 ejected from the nozzle 20 under a relatively higher pressure will have a greater compressive effect on the work piece than a fluid ejected from the nozzle at a relatively lower pressure. Thus, the pressure of the fluid 26 and the speed at which the fluid is ejected from the nozzle 20 can be selected based on the desired compression of the work piece 12. The speed at which fluid 26 is ejected from the nozzle 20 can also be affected by the size of the opening 24 of the nozzle. Those skilled in the art will appreciate that a fluid ejected from a relatively large opening will travel slower than the same fluid ejected from a relatively smaller opening.

If the work piece 12 is rotated too slowly as the nozzle 20 is moved along the length of the support 16, then the fluid 26 can create a spiral channel in the work piece. To avoid the work piece 12 being deformed in such a way, it is desirable to rotate the work piece 12 at a rate great enough to ensure that fluid 26 from the nozzle 20 acts over the entire surface of the work piece. The rate of rotation of the work piece 12 may be such that the fluid 26 from the nozzle 20 acts on the same portion of the work piece more than once before the nozzle is moved in the direction of the longitudinal axis X of the work piece.

Figure 3:
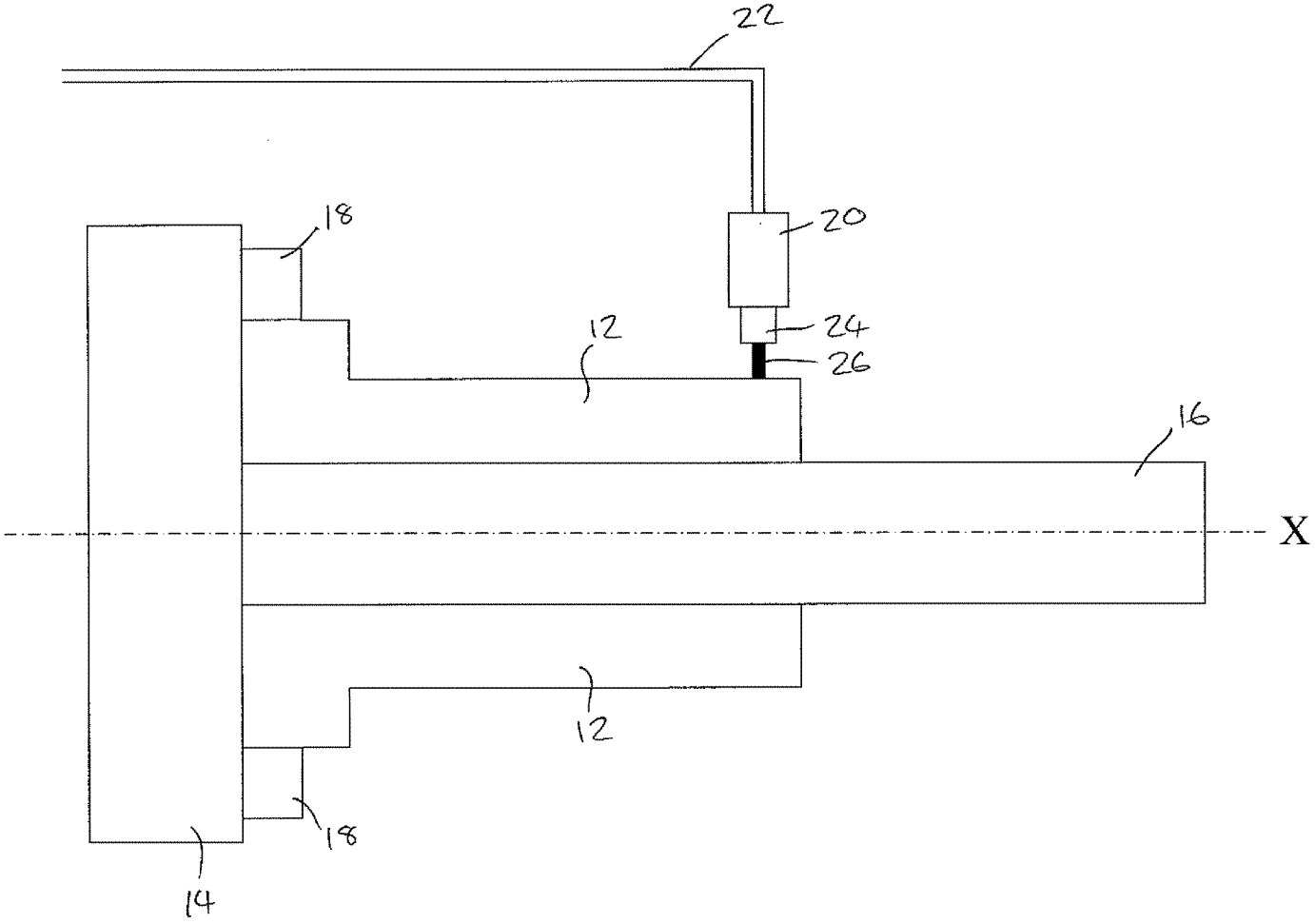
FIG. 3 is a schematic cross section through an apparatus constructed in accordance with a second embodiment of the invention.

In another embodiment of the invention, an example of which is shown in FIG. 3, the nozzle 20 is capable of moving in a direction transverse to the longitudinal axis X of the work piece 12. In other words, the nozzle 20 is capable of moving radially inwards towards the work piece 12, and radially outwards away from the work piece. Such an arrangement enables control over the effect of the fluid from the nozzle 20 on the work piece 12. It will be appreciated that when the nozzle 20 is moved nearer to the work piece 12 the force of the fluid 26 acting on the work piece will increase and consequently the deforming effect on the work piece will be greater. Thus, the resulting desired deforming effect of the work piece 12 can be achieved by moving the nozzle 20 towards and/or away from the work piece as required. The ability to moved the nozzle radially with respect to the work piece 12 may be combined with the ability to move the nozzle in a direction transverse to the longitudinal axis X of the work piece, so that a single nozzle is capable of acting over the entire length of the work piece.

In an alternative embodiment, not shown in the drawings, the nozzle 20 is additionally or alternatively capable of pivoting relative to the work piece 12, so that fluid 26 expelled from the nozzle can be directed towards that end of the work piece nearest to the lathe 14 and/or towards that end of the work piece distal from the lathe.

Figure 4:
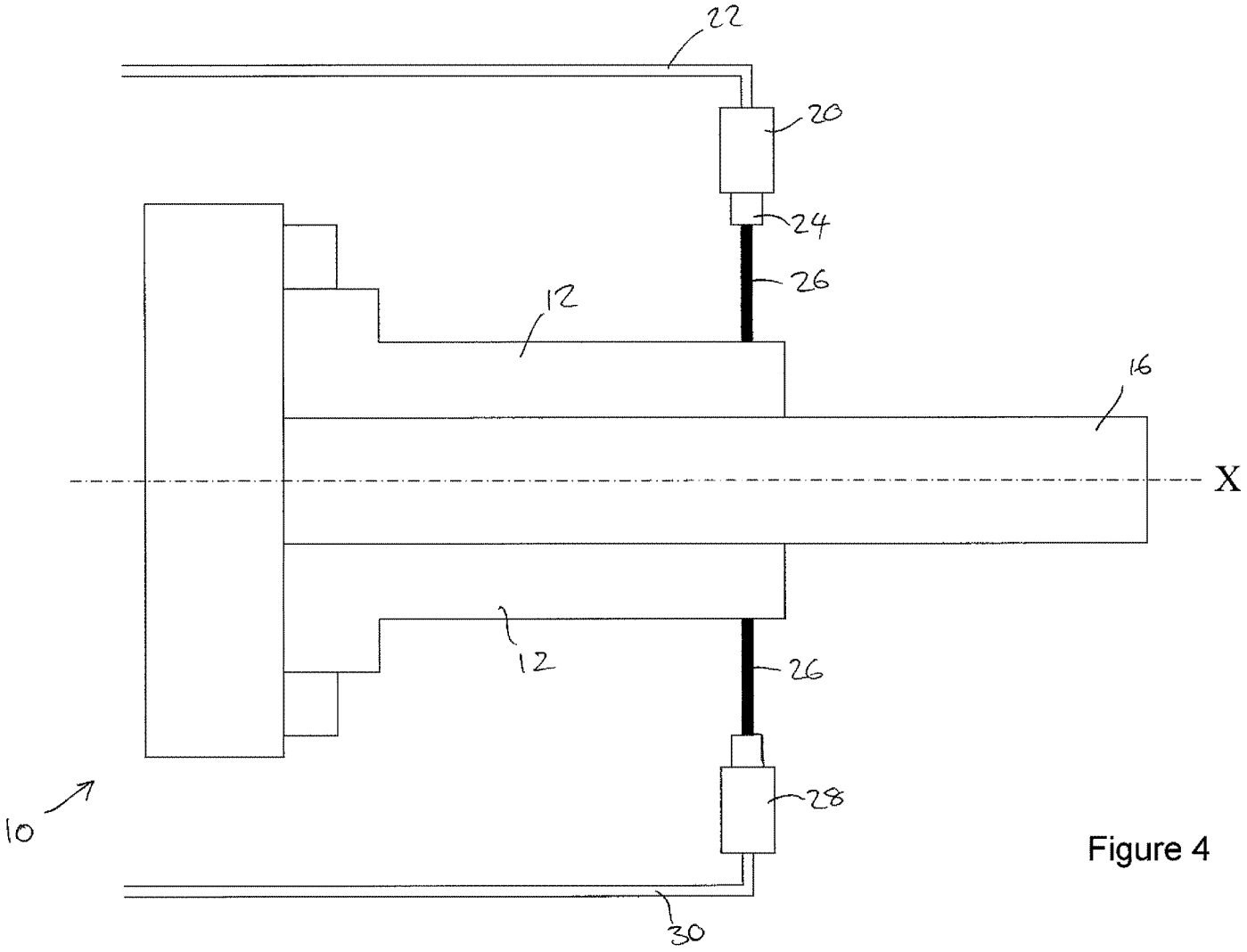
FIG. 4 is a schematic cross section through an apparatus constructed in accordance with a third embodiment of the invention.

FIG. 4 shows an alternative embodiment of the invention in which an additional nozzle 28 is provided on the diametrically opposite side of the work piece 12 to the nozzle 20. The nozzle 28 is directed at the work piece 12 from the opposite side of the support 16. The nozzle 28 may be connected via a fluid pipe 30 to the same fluid source (not shown) to which the fluid pipe 22 is connected or to a separate fluid source (not shown). It will be appreciated that with an increased number of nozzles directing fluid 26 onto the work piece 12 the fluid will need to be applied to the work piece for a shorter duration to achieve the same deforming effect. In other words, two nozzles 20, 28 can achieve the same deforming effect on the work piece 12 in half the time that a single nozzle 20 could achieve the same effect, given the same fluid at the same pressure.

It will be appreciated that additional nozzles (not shown) could be added to the apparatus 10, located around a circumference of the work piece 12. For example, one or more additional nozzles could be added at locations equidistant between the nozzle 20 and the nozzle 28, in order to further increase the amount of fluid being used to deform the work piece and, consequently, further reducing the duration that the nozzles would need to expel fluid.

Figure 5:
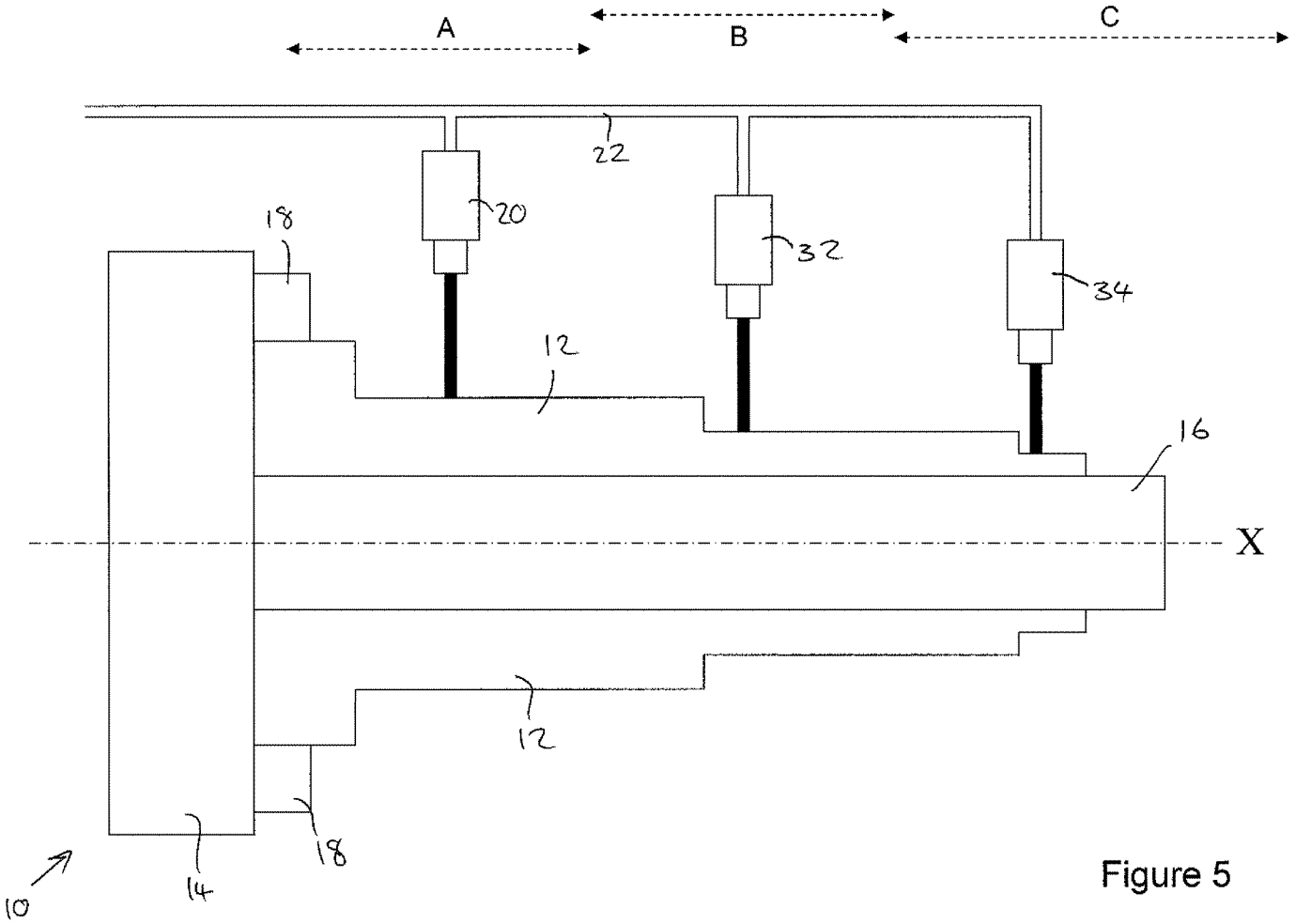
FIG. 5 is a schematic cross section through an apparatus constructed in accordance with a fourth embodiment of the invention.

In FIG. 5, an embodiment of the invention is shown in which multiple nozzles 20, 32, 34 are provided along at least a portion of the length of the support 16. The arrangement of nozzles in this embodiment reduces the need of an individual nozzle (such as the nozzle 20 in the embodiment shown in FIGS. 1 and 2) to be moveable along the entire length of the support 16. Instead, each of the nozzles 20, 32, 34 is able to move a short distance along the length of the support 16 in order to direct fluid onto a portion of the work piece 12. For example, in the embodiment shown in FIG. 5, the nozzle 20 is able to move along the support 16 over a distance denoted by dashed arrow A, the nozzle 32 is able to move along the support over a distance denoted by dashed arrow B, and the nozzle 34 is able to move along the support over a distance denoted by dashed arrow C.

In the embodiment shown in FIG. 5, each of the nozzles 20, 32 and 34 is connected to a single fluid delivery pipe 22, and each nozzle receives fluid from the same fluid source (not shown). In an alternative embodiment, each nozzle 20, 32, 34 may receive fluid from a separate fluid source (not shown), and via a separate fluid delivery pipe (not shown).

The nozzles 20, 32, 34 are capable of being moved in a direction transverse to the longitudinal axis X of the work piece 12. In other words, the nozzles can be moved towards the work piece 12 to increase the pressure of the fluid 26 being directed onto the work piece. In FIG. 5, the nozzle 32 is closer to the support 16 than the nozzle 20 and the nozzle 34 is closer to the support than the nozzle 32. It should be noted that FIG. 5 represents a snapshot of the work piece deformation process after a period of deformation of the work piece has already elapsed.

Typically, the work piece 12 is initially a cylindrical tubular work piece having a relatively thick wall. The work piece 12 will be acted on first by fluid 26 from the nozzle 20. As the work piece 12 is deformed, the thickness of its wall decreases and its length increases until it extends within range of the nozzle 32. If needed, the nozzle 32 can be moved inwards towards the work piece 12. Fluid 26 from the nozzle 32 further deforms the work piece 12, further thinning the wall and increasing its length until it extends within range of the nozzle 34. The nozzle 34 can if needed be moved inwards towards the work piece 12.

One advantage of this arrangement is that the force of the fluid hitting the work piece is approximately equal from each of the nozzles 20, 32, 34 as the nozzles 32 and 34 are closer to the work piece and, therefore, cancel out the inevitable reduction in pressure resulting from the extra distance along which the fluid must travel along the fluid delivery pipe 22 to reach the nozzles 32 and 34. A second advantage of this arrangement is that the portion of work piece 12 being acted upon by the nozzles 32 and 34 is thinner than the portion of the work piece being acted upon by the nozzle 20. Therefore, by positioning the nozzles 32 and 34 closer to the support 16, the distance between the nozzles and the work piece can be kept the same.

Figure 6:
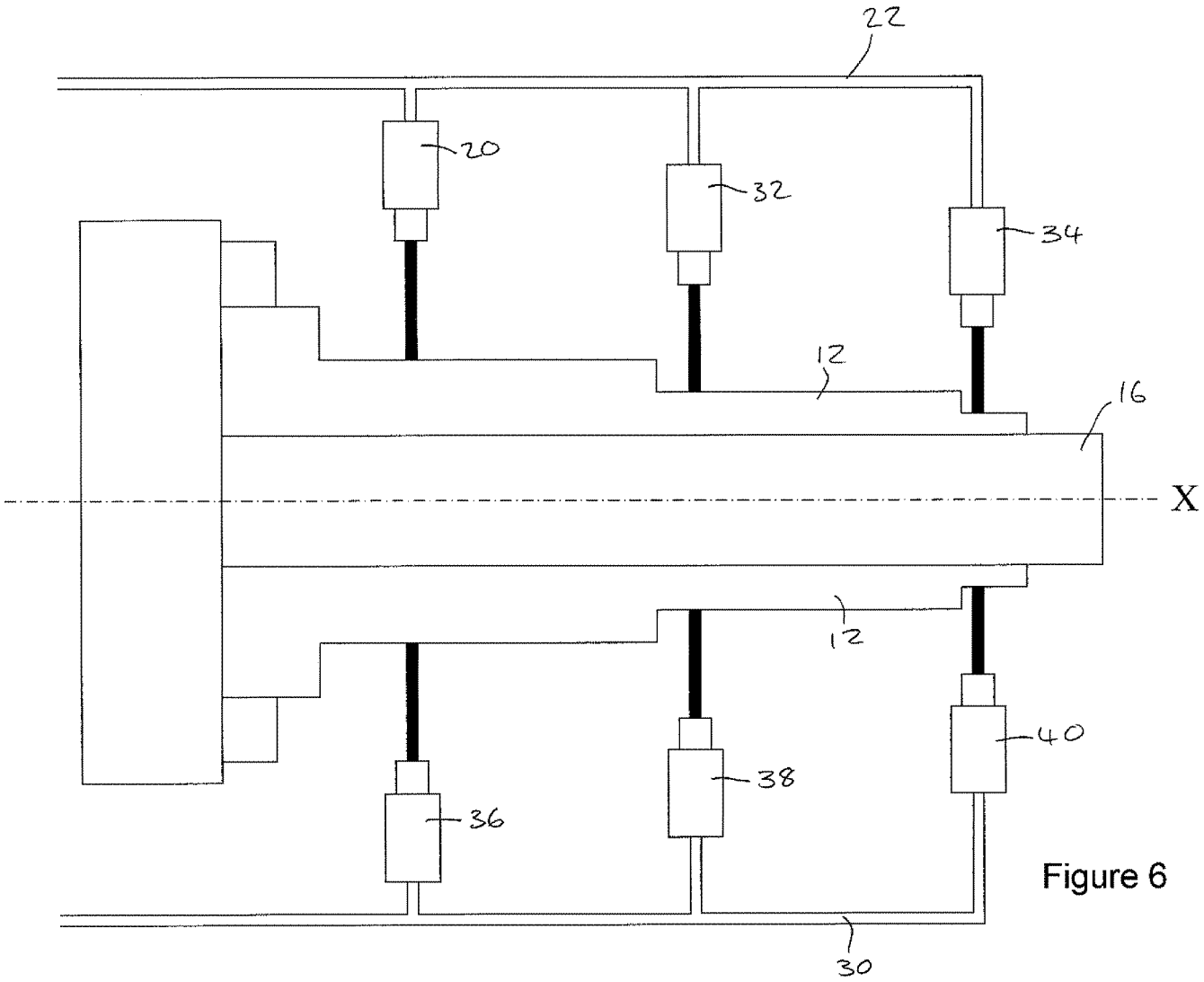
FIG. 6 is a schematic cross section through an apparatus constructed in accordance with a fifth embodiment of the invention.

In addition to having a plurality of nozzles 20, 32, 34 arranged along the length of the support 16, in the embodiment shown in FIG. 6, the apparatus 10 includes further nozzles 36, 38, 40 arranged diametrically opposite to the nozzles 20, 32, 34 respectively, on the diametrically opposite side of the support 16. As with the embodiment described in connection with FIG. 4, the apparatus then may further include additional nozzles (not shown) arranged, for example, at regular intervals around the support 16. Again, it will be appreciated by those skilled in the art that, by increasing the number of nozzles expelling fluid onto the work piece 12, the duration for which the fluid must be expelled onto the work piece can be reduced.

In the embodiments described above, the nozzles 20, 32, 34, 36, 38, 40 have been described as being moveable, either in a direction parallel to the longitudinal axis X of the work piece 12, radially towards and/or away from the work piece, or pivotally with respect to the work piece. However, in an alternative embodiment, the nozzles may be configured to remain stationary, and the work piece 12 may be configured to move parallel to and/or in a direction transverse to the longitudinal axis X of the work piece 12. In other words, the ability to accurately deform the work piece in a desirable manner requires the nozzles and/or the work piece to be movable with respect to one another.

The fluid 26 expelled from the nozzles 20, 32, 34, 36, 38, 40 towards the work piece 12 may be a gas (for example oxygen, carbon dioxide, hydrogen or nitrogen), a liquid (for example water or oil) or some other fluidic material, such as a gel or foam. In some embodiments, the fluid may contain additional material, such as solid material (for example shot or an abrasive). The addition of an abrasive to the fluid 26 can increase the deforming effect of the fluid on the work piece 12.

In the embodiments of the invention described herein, there has been an implication that it is desirable to deform the work piece 12 in a uniform manner, in order to achieve a resulting deformed work piece having a wall of uniform thickness. In some cases, however, it may be desirable to deform the work piece 12 in a non-uniform way, for example by creating a series of steps along the length of the work piece, with each step having a different thickness, or by creating an undulating exterior surface on the work piece. It will be appreciated that, by varying the type of fluid 26, the speed at which the fluid is directed towards the work piece 12, and the duration for which the work piece is worked, one is able to deform the work piece in such a way that any desirable profile and wall thickness can be achieved.

So far, the invention has been described in terms of individual embodiments. However, those skilled in the art will appreciate that various embodiments of the invention, or features from one or more embodiments, may be combined as required. It will be appreciated that various modifications may be made to these embodiments without departing from the scope of the invention, which is defined by the appended claims.

The invention claimed is:

1. A forming apparatus comprising:

a support for supporting a hollow tubular work piece, the tubular workpiece comprising a wall with an initial thickness and an initial length extending along a longitudinal axis of the tubular work piece, wherein an outer surface of the support supports an inner surface of the wall of the tubular work piece along the longitudinal axis of the tubular work piece;

rotation means for rotating the tubular work piece about the longitudinal axis;

a nozzle for directing a stream of pressurised fluid at the tubular work piece in a direction transverse to the longitudinal axis;

wherein one or both of the tubular work piece and the nozzle is movable relative to the other such that the stream of pressurised fluid can be aimed at a plurality of locations along the tubular work piece; and wherein the nozzle is configured to direct the stream of pressurised fluid at the tubular workpiece supported on the support at a pressure great enough to cause deformation of the tubular work piece such that the initial thickness of the wall of the tubular work piece is thinned and the initial length of the tubular work piece is increased, but not so great that cutting of the tubular work piece can occur.

2. The forming apparatus according to claim 1, wherein the support comprises a mandrel.

3. The forming apparatus according to claim 1, wherein the rotation means comprises a lathe.

4. The forming apparatus according to claim 1, wherein the support and the rotation means comprise a mandrel.

5. The forming apparatus according to claim 1, wherein the nozzle is configured to move in a direction transverse to the longitudinal axis.

6. The forming apparatus according to claim 1, wherein the nozzle is mounted on a rail to enable it to be moved relative to the tubular work piece.

7. The forming apparatus according to claim 1, wherein the nozzle is pivotable relative to the tubular work piece.

8. The forming apparatus according to claim 1, wherein the pressurised fluid comprises water.

9. The forming apparatus according to claim 8, wherein the pressurised fluid further comprises an abrasive.

10. The forming apparatus according to claim 1, wherein the nozzle comprises one of a plurality of nozzles arranged circumferentially around the tubular work piece.

11. The forming apparatus according to claim 1, wherein the nozzle comprises one of a plurality of nozzles arranged at different positions along the longitudinal axis.

12. The forming apparatus according to claim 1, wherein the nozzle comprises one of a plurality of nozzles, each of the nozzles being positioned at a different radial distance from the tubular work piece.

13. The forming apparatus according to claim 12, wherein the nozzles of each individual set of nozzles are arranged circumferentially around the tubular work piece.

14. The forming apparatus according to claim 1, wherein the nozzle is configured to move in a direction along the longitudinal axis.

15. A method for deforming a tubular work piece, the method comprising:

providing a hollow tubular work piece, the tubular workpiece comprising a wall with an initial thickness and an initial length extending along a longitudinal axis of the tubular work piece;

directing a stream of pressurised fluid at the tubular work piece in a direction transverse to the longitudinal axis;

rotating the tubular work piece about the longitudinal axis; and moving one or both of the tubular work piece and the stream of pressurized fluid such that the stream of pressurised fluid is aimed at a plurality of locations along the tubular work piece;

wherein the pressure of the pressurised fluid directed at the tubular work piece is great enough to cause deformation of the tubular work piece such that the initial thickness of the wall of the tubular work piece is thinned and the initial length of the tubular work piece is increased, but not so great that cutting of the tubular work piece can occur.

16. A method according to claim 15, wherein the pressurised fluid is directed at the tubular work piece by a nozzle, and the nozzle is moved in a direction transverse to the longitudinal axis of the tubular work piece, as the tubular work piece is rotated.

17. A method according to claim 15, wherein the pressurised fluid is directed at the tubular work piece by a nozzle mounted on a rail, and the method further comprises:

moving the nozzle along the rail relative to the tubular work piece.

18. A method according to claim 15, wherein the pressurised fluid is directed at the tubular work piece by a plurality of nozzles, each of the nozzles being movable independently relative to the tubular work piece.

19. A method according to claim 15, wherein the pressurised fluid is directed at the tubular work piece by a plurality of nozzles, each of the nozzles being positioned at a different radial distance from the tubular work piece, and movable relative to the tubular work piece and to the others of the plurality of nozzles.

20. A method according to claim 15, wherein the pressurised fluid is directed at the tubular work piece by a nozzle, and the nozzle is moved along the longitudinal axis of the tubular work piece.

* * * * *